United States Patent [19]

Quiogue et al.

[11] Patent Number: 4,559,587

[45] Date of Patent: Dec. 17, 1985

[54] WALL MOUNTED LUMINAIRE

[75] Inventors: Honesto D. Quiogue, Blacksburg, Va.; Ian Lewin, Scottsdale, Ariz.

[73] Assignee: Harvey Hubbell Incorporated, Orange, Conn.

[21] Appl. No.: 552,620

[22] Filed: Nov. 17, 1983

[51] Int. Cl.[4] ..... F21S 3/02

[52] U.S. Cl. ..... 362/147; 362/223; 362/263; 362/296; 362/310

[58] Field of Search ..... 362/307, 308, 309, 310, 362/296, 263, 147, 328, 339, 333, 223, 151, 299, 300

[56] References Cited

U.S. PATENT DOCUMENTS

| | | | |
|---|---|---|---|
| D. 206,019 | 10/1966 | Walz | D48/4 |
| 3,184,199 | 5/1965 | Clark et al. | 362/269 |
| 3,251,987 | 5/1966 | Wince | 362/339 |
| 3,340,393 | 9/1967 | Franck et al. | 362/328 |
| 3,524,051 | 8/1970 | Baldwin et al. | 362/309 |
| 3,539,795 | 11/1970 | Hawley | 362/263 |
| 4,155,111 | 5/1979 | Kelly et al. | 362/307 |
| 4,156,902 | 5/1979 | Wandler | 362/307 |
| 4,217,629 | 8/1980 | Russell | 362/150 X |
| 4,237,528 | 12/1980 | Baldwin | 362/432 X |
| 4,290,096 | 9/1981 | Szpur | 362/223 |
| 4,343,032 | 8/1982 | Schwartz | 362/276 |
| 4,349,866 | 9/1982 | Molnar | 362/263 |
| 4,398,239 | 8/1983 | de Vos et al. | 362/310 |

FOREIGN PATENT DOCUMENTS

| | | | |
|---|---|---|---|
| 770464 | 3/1957 | United Kingdom | 362/307 |
| 837336 | 6/1960 | United Kingdom | 362/307 |

*Primary Examiner*—Craig R. Feinberg
*Assistant Examiner*—David A. Okonsky
*Attorney, Agent, or Firm*—Jerry M. Presson; Walter C. Farley

[57] ABSTRACT

An outdoor luminaire for lighting a region adjacent a vertical wall includes a housing having an upper portion for containing the circuitry to energize a lamp and a lower portion with a reflector, a lamp socket and a transparent refractor enclosing the socket and reflector region. The socket and reflector are inclined downwardly toward the rear of the assembly and the reflector is formed with a U-shaped central portion and rearwardly and outwardly extending side portions. The refractor is provided with inside and outside prisms to direct the light in a predetermined pattern which is generally laterally to both sides of the fixture.

10 Claims, 9 Drawing Figures

WALL MOUNTED LUMINAIRE

This invention relates to a luminaire for lighting a specific area and, in particular, to a luminaire for casting a broad spread of light adjacent a wall.

BACKGROUND OF THE INVENTION

In numerous architectural applications, it is highly desirable to have a fixture which can be mounted alone, or in conjunction with similar fixtures, to provide uniform illumination at a suitably high level in the vicinity of walls forming outdoor passageways or in the vicinity of access doors.

While numerous luminaires for this general purpose are available, each has some shortcomings which render it unsuitable over an extended interval of time.

BRIEF SUMMARY OF THE INVENTION

Accordingly, it is an object of the present invention to provide an improved wall mountable luminaire for providing a broad illumination pattern adjacent the wall with high efficiency.

It is a further object to provide such a luminaire which, in addition to being efficient and attractive, is highly resistant to vandalism, is easy to install, and, without changing the basic design, can be used under a variety of circumstances.

Briefly described, the invention comprises a luminaire for illuminating an area adjacent a generally vertical surface comprising a housing having a generally rectangular back portion with a surface adapted to be mounted against the vertical surface, by attachment either to the vertical surface or to an adjacent downwardly-facing horizontal surface. The housing includes an enclosed upper portion extending away from the back portion for supporting a generally downwardly extending lamp socket, the upper portion also containing electrical components associated with energization of a lamp. A lower portion of the housing supports a reflector, the housing having a lamp socket supported in the upper portion and extending into the lower portion with the central axis of these sockets inclined at an acute angle relative to the back portion and toward the lower end of the back portion so as to support a lamp with its axis similarly inclined. The reflector has an elongated central portion which is U-shaped in cross section and extends at an acute angle paralleling the lamp and socket, partially encircling the sides of the lamp. The reflector also has side portions extending rearwardly and outwardly from the distal edges of the central portion. A transparent refractor having a front wall, side walls and a bottom wall is shaped to enclose the lower portion of the housing which includes the lamp, the socket and the reflector. Finally, the apparatus includes means for releasably attaching the refractor to the lower portion.

In addition, the refractor includes a relatively large number of prisms on the inner and outer surfaces to direct the light from the lamp, and from the reflector, into the desired pattern.

In order that the manner in which the foregoing and other objects are obtained in accordance with the invention can be understood in detail, a particularly advantageous embodiment thereof will be described with reference to the accompanying drawings, which form a part of this specification and wherein.

DETAILED DESCRIPTION OF THE DRAWINGS

Figure 2:
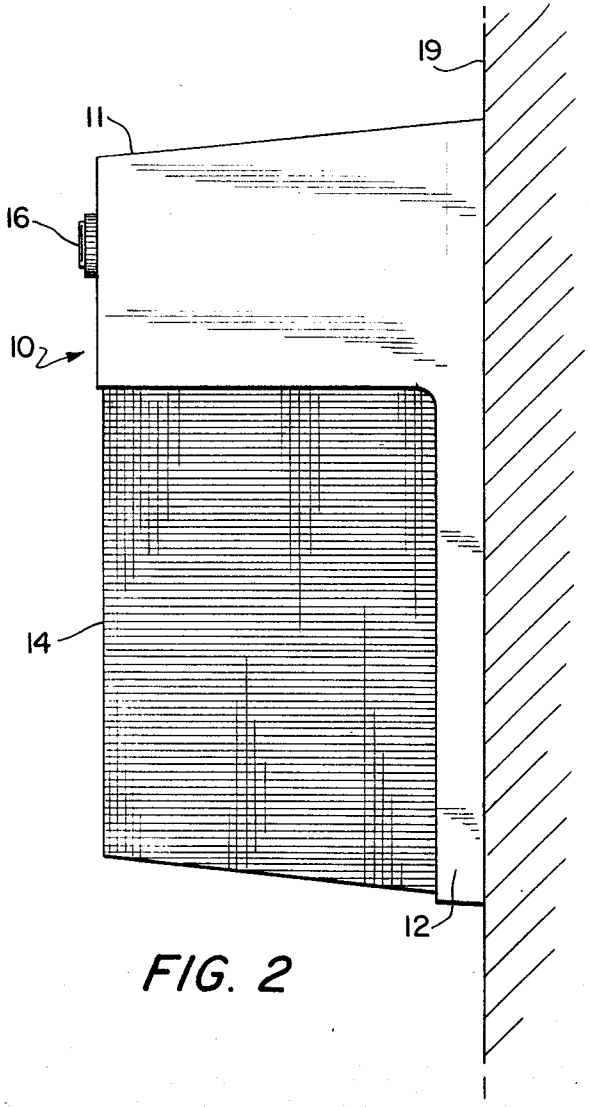
FIG. 2 is a side elevation of the luminaire of FIG. 1 shown in a position mounted against a vertical surface.
Figure 1:
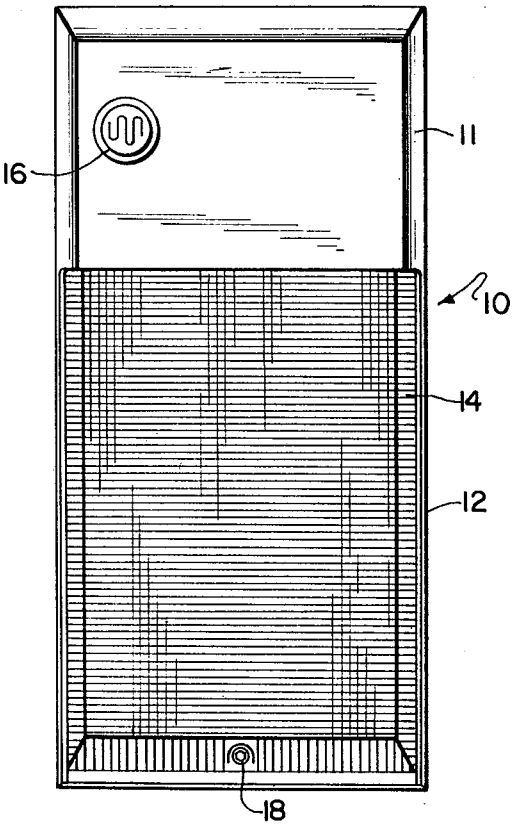
FIG. 1 is a front elevation of an assembled luminaire in accordance with the present invention.

FIGS. 1 and 2 show a luminaire in accordance with the invention which includes a housing indicated generally at 10 having an upper portion 11 and a lower portion 12 and supporting a refractor 14 which is removably attached to the housing and encloses the front of the lower portion thereof. The upper portion 11 of the housing forms a hollow chamber to house the electrical components necessary to operate a lamp such as, for example, a ballast and capacitors for use with a high pressure sodium lamp, a transformer for use with a fluorescent lamp, and the like. The upper portion 11 can also be provided with circuitry responsive to ambient light conditions to automatically energize and de-energize the lamp within the luminaire refractor, for which purpose the front portion 11 can be provided with a mounting for a photo-responsive cell 16. The circuitry for accomplishing the switching is conventional and will not be further described.

Housing 10 is preferably produced by an injection molding process using, for example, a bronze polycarbonate material. Refractor 14 is a prismatic polycarbonate refractor which can also be produced by injection molding. As schematically shown in FIGS. 1 and 2, the surfaces of the refractor are provided with a relatively large number of prisms to direct the light and these will be described in somewhat greater detail. It will also be observed that the refractor is removably retained in the position shown on the housing by a single fastener 18 which passes through an opening at the bottom of the refractor and into the housing.

Figure 3:
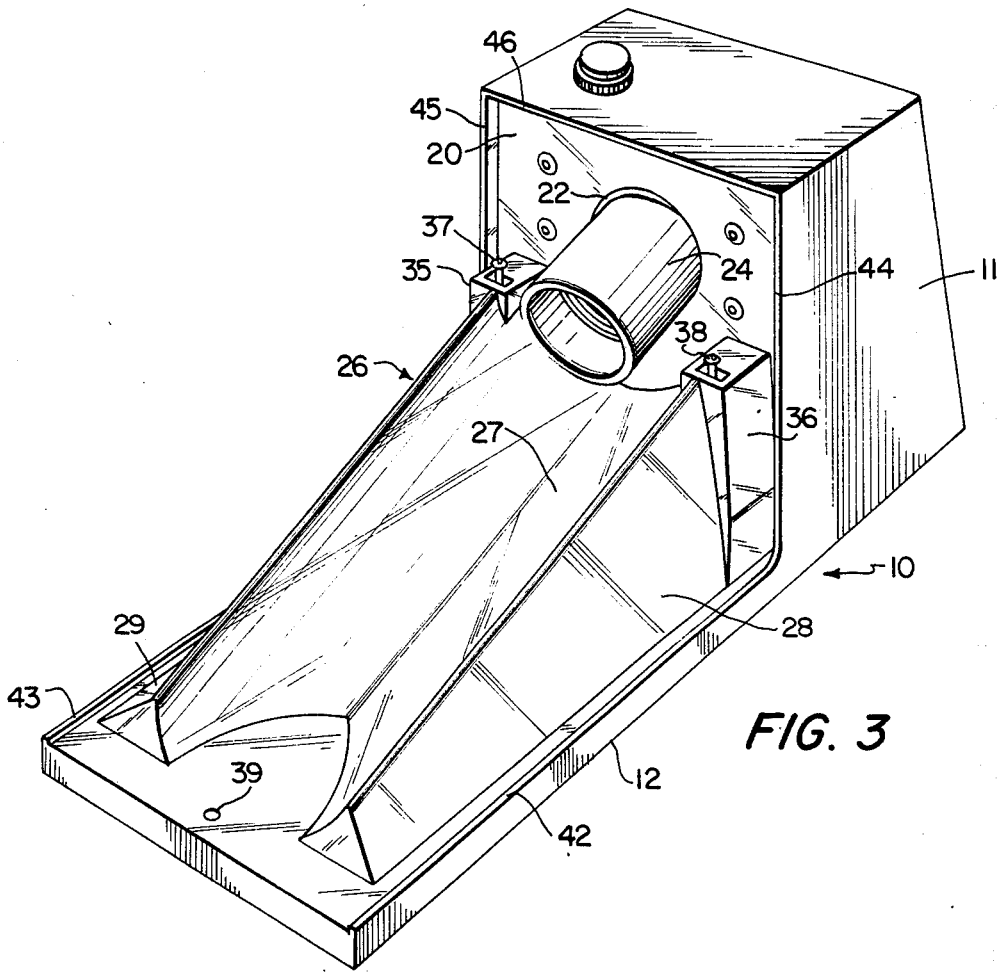
FIG. 3 is a perspective view of the luminaire of FIGS. 1 and 2 with the refractor removed to expose the lower portion of the housing.
Figure 4:
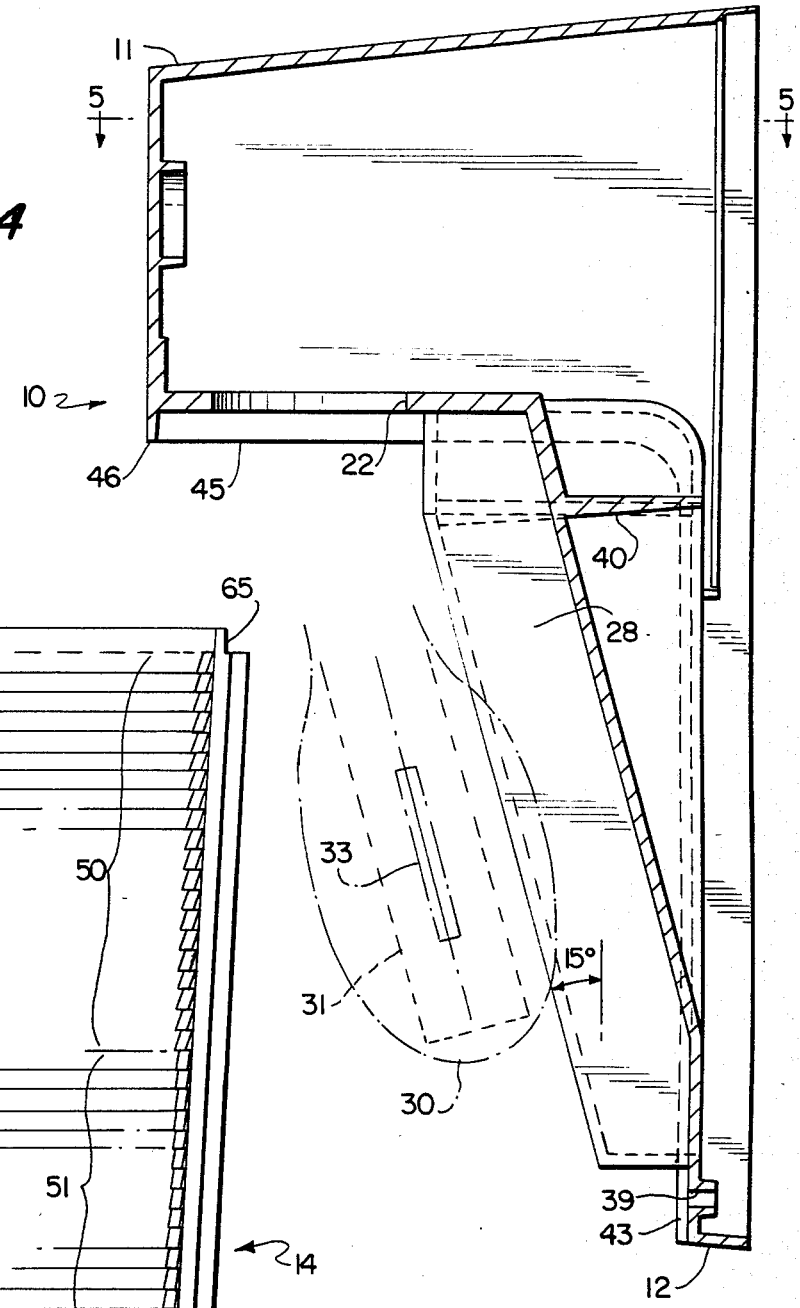
FIG. 4 is a side elevation in section, of the housing portion of the luminaire.

FIG. 3 shows a perspective view of the housing with the refractor removed. From FIGS. 1–3, it will be recognized that the housing has a generally rectangular back surface which is intended to be mounted against a vertical surface 19 such as a wall or the like with portion 11 uppermost. With minor modifications, the structure can be arranged to be supported from the top surface of portion 11, that embodiment not being illustrated. The downwardly facing end of housing portion 11 is closed by a floor 20 which can be integrally molded with the remainder of the housing, floor 20 having an opening 22 to permit penetration of a lamp socket 24. Behind and below socket 24 is a reflector 26 having a central, generally U-shaped portion 27 and outwardly facing, rearwardly extending side portions 28 and 29, the majority of surface 29 not being visible in FIG. 3. As seen in FIGS. 3 and 4, the U-shaped portion 27 does not extend perpendicularly downwardly from wall 20 but, rather, is inclined rearwardly and downwardly to form an acute angle with respect to the rear surface. Furthermore, lamp socket 24 does not extend perpendicularly through opening 22 but, rather, extends at an inclined angle toward the rear of the housing paralleling the axis of the U-shaped portion. The angle between vertical and the axes of the lamp socket and reflector is preferably between about 10° and about 30° and, as shown, is about 15°. The outlines of a typical HPS lamp envelope 30 and of a fluorescent lamp 31 are illustrated in FIG. 4 to show the general relationship of these envelopes with the reflector and the remainder of the housing. It will be observed that, in either case, the light source is an elongated one, the elongated arc source of an HPS lamp being outlined at 33. It will be noted that the elongated source 33 lies approximately in the longitudinal middle of the reflector. It will also be recognized from FIGS. 3 and 4, as well as from FIG. 5, that the reflector and the upper and lower portions of the housing are formed at the same time and as a single unit, resulting in relatively simple, inexpensive and rapid production. The reflective surfaces 26, 27 and 28, as well as the exposed surface of wall 20, are vacuum metalized with aluminum to provide highly reflective surfaces.

At the upper ends of the edges joining surfaces 26, 27 and 27, 28 are structural pillars 35 and 36 through which screws 37 and 38 extend, respectively. Screws 37, 38 extend through the back of the unit, providing two-point mounting which not only simplifies installation from the front of the unit but also prevents rotation after mounting. At the lower end of the bottom portion is an opening 39 to receive mounting screw 18 which retains the refractor 14 in position.

Figure 5:
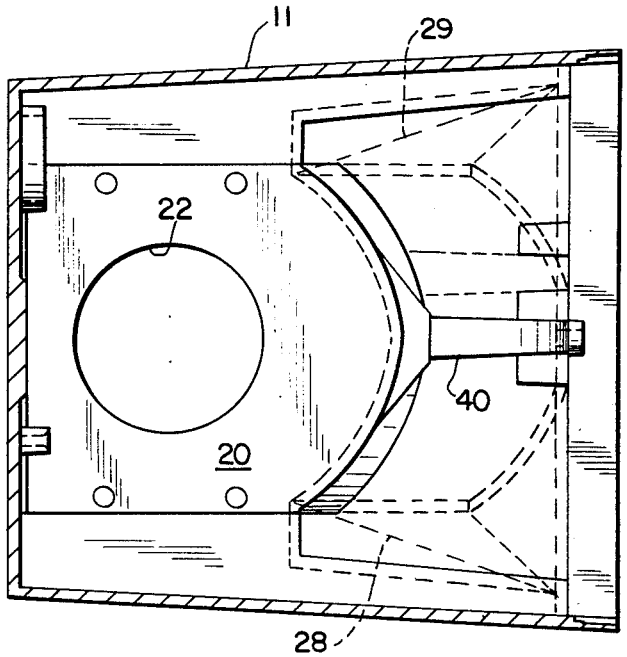
FIG. 5 is a transverse sectional view along line 5—5 of FIG. 4.

FIG. 5 additionally illustrates the hollow interior of upper portion 11 of the housing which is provided to contain the ballast and the like for operating a lamp mounted in socket 24. FIG. 5 also illustrates the fact that the region behind reflective surfaces 27–29 is hollow and is substantially uninterrupted except by a structural brace 40, permitting heat dissipation.

Figure 6:
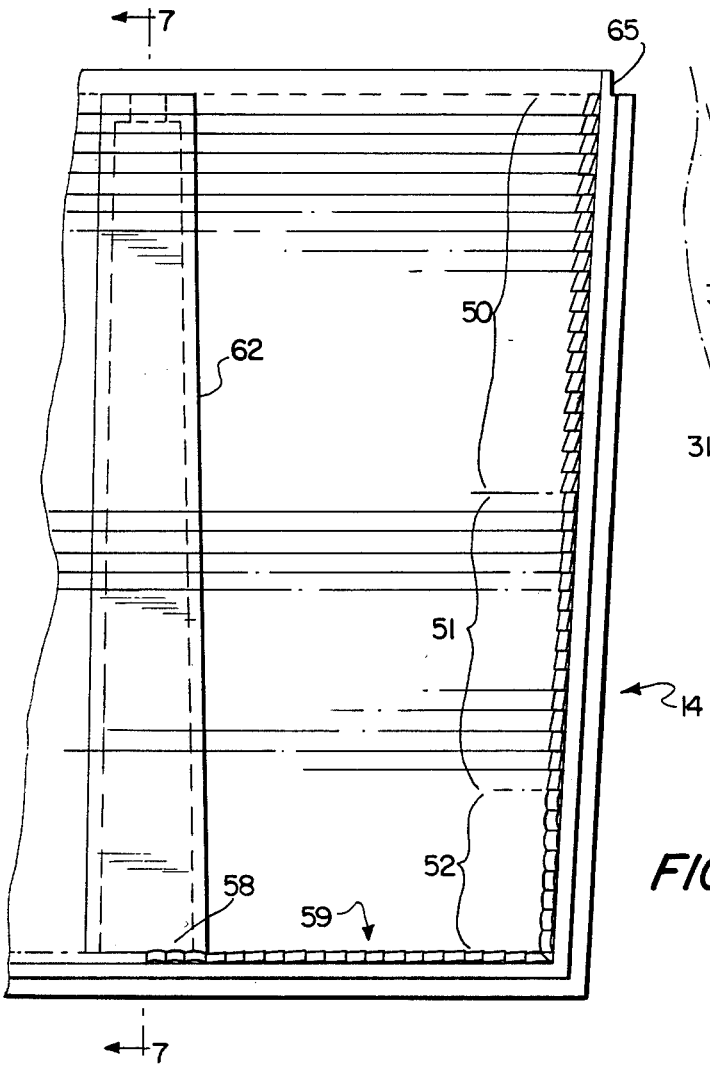
FIG. 6 is a partial top plan view of the refractor portion of the assembly of FIGS. 1 and 2.
Figure 7:
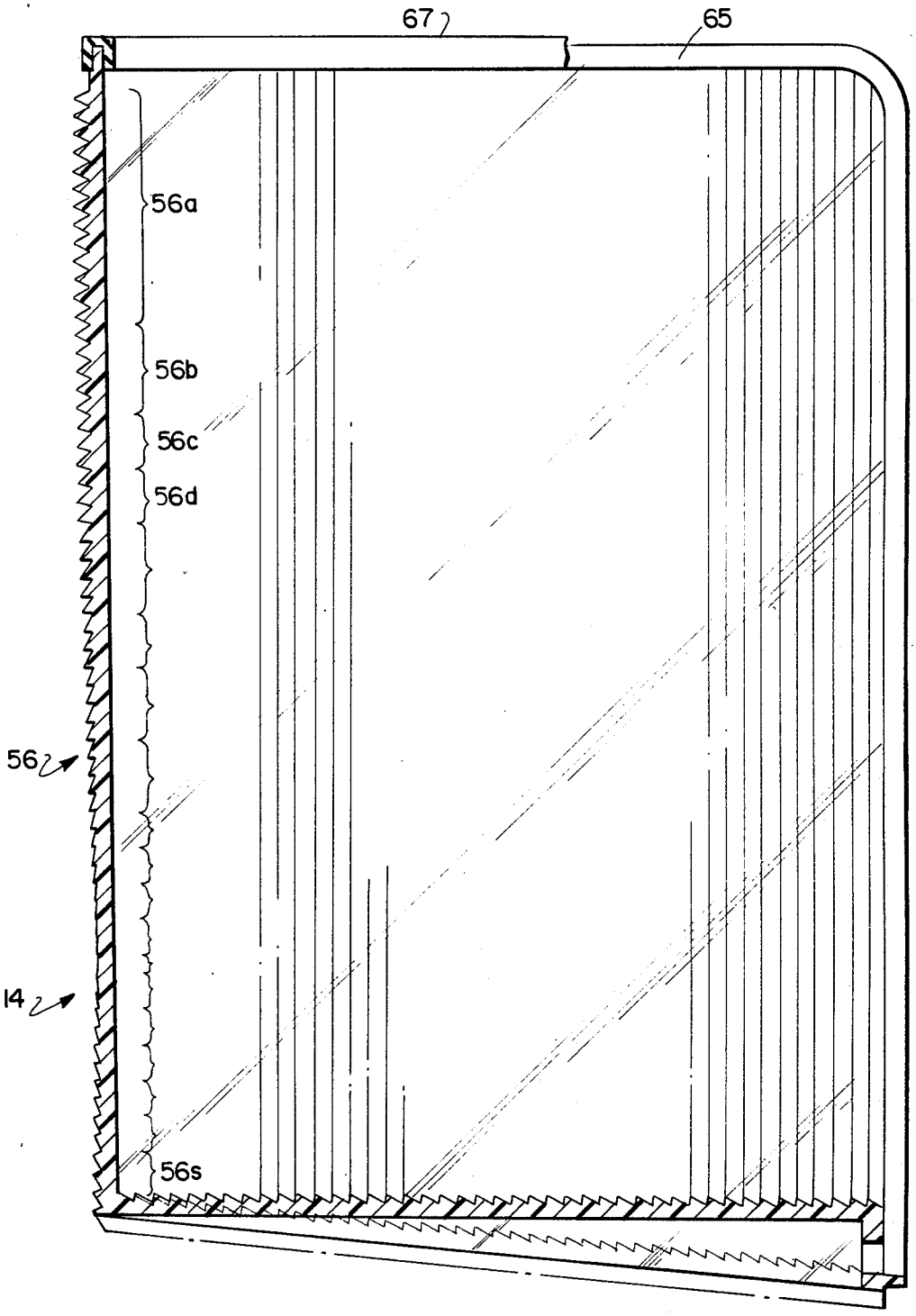
FIG. 7 is a side elevation, in section, along line 7—7 of FIG. 6.
Figure 8:
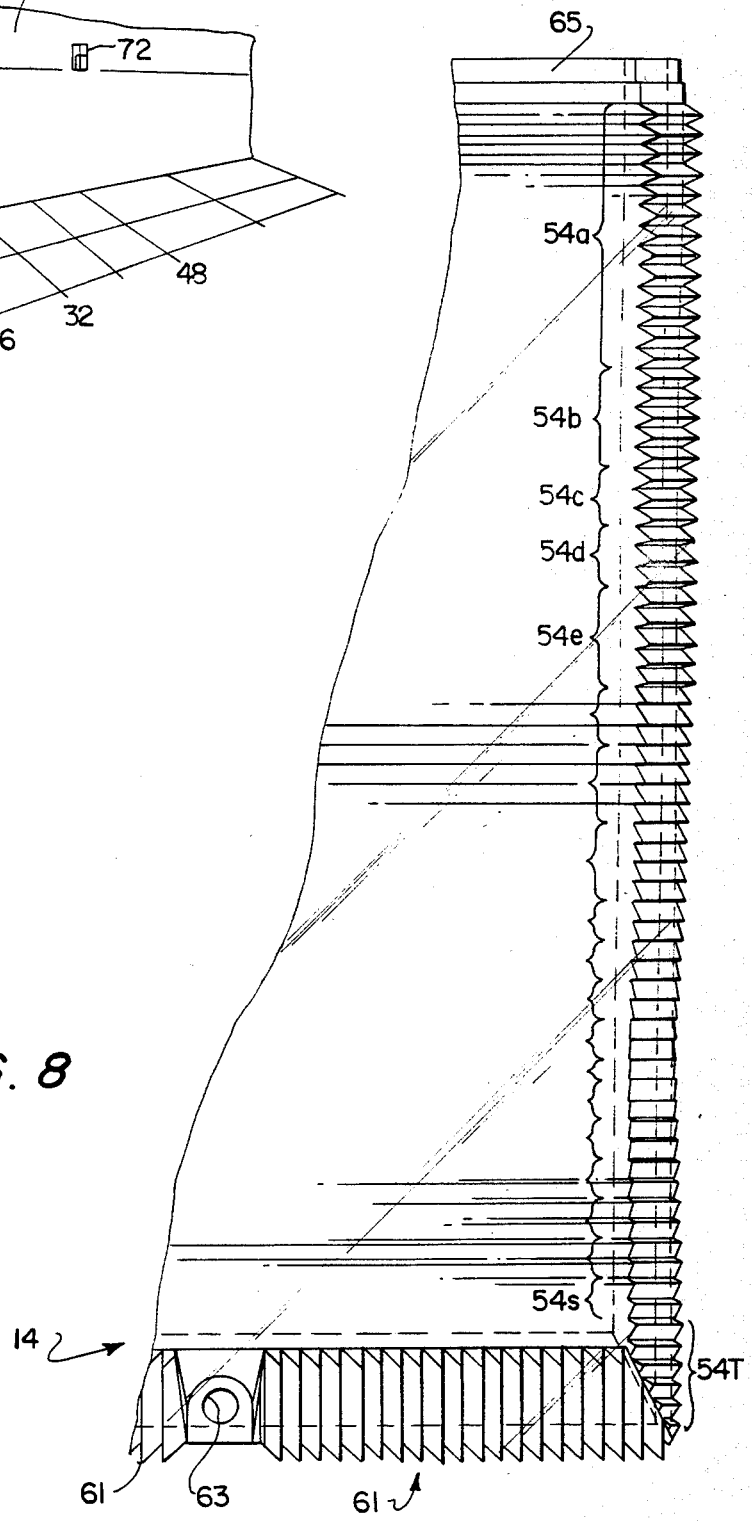
FIG. 8 is a partial front elevation of the refractor of FIGS. 6 and 7.

Lower portion 11 includes, laterally outward of reflective surfaces 28 and 29, relatively short walls 42 and 43 which merge smoothly into similar walls 44 and 45 at the lateral limits of wall 20. At the front is a wall 46 which interconnects walls 44 and 45, this combination providing a recess into which the refractor 14 is received. The refractor itself is illustrated in some detail in FIGS. 6, 7 and 8, FIG. 7 showing a side elevation of the refractor, at an enlarged scale, as it fits into the housing as illustrated in FIG. 4 and surrounds and encloses the lamp and reflector structures. As best seen in FIG. 6, the inner surface of the side wall of refractor 14 has a plurality of vertically extending prisms with shapes varying from a portion 50 in which each prism, in section, has the shape of an acute right triangle with the smallest angle pointing toward the rear of the refractor and having an angle of about 20°, a portion 51 forwardly thereof in which the same angle has a value of approximately 10° and a third portion 52 which includes a plurality of convex, rounded flutes.

The outer surface of this same wall, best seen in FIG. 8, includes a plurality of horizontally extending prisms. As will be seen in FIG. 8, the side wall tapers outwardly toward the rear of the refractor, and has a somewhat more complex array of prisms than the inner surface. These prisms actually form twenty different groups, the prisms within each group being identical but differing in some respects from each other group. These groups, which are identified as 54*a–t*, vary from a nearly isosceles triangle prism at group a, in which the upper surface forms an angle of about 27° with a horizontal and the lower surface an angle of about 22°, to a prism which is substantially flat at 54*m* and then increasing again, but with the prisms "leaning" in the other direction, to section 54*t* in which the upper surface forms an angle of about 55° with the horizontal and the lower surface an angle of about 31°.

The outer surface 56 of the front of the refractor has a plurality of horizontally extending prisms which follow a pattern identical to that at the outer surface 54 of the side. The inner surface of the front has a plurality of vertically extending prisms, best seen in FIG. 6, in which the central portion 58 is a series of convex, rounded ribs and the prism 59 on either side thereof are relatively shallow triangular prisms. As will be recognized, the opposite side is identical to the side discussed.

The bottom of the refractor includes side portions 60 and 61 and a central channel 62 which is provided for access to opening 63 which, on assembly, is aligned with opening 39 through which fastener 18 extends. The prisms are substantially identical and have angles of approximately 50° from the vertical at those surfaces facing toward the center.

As seen in FIGS. 6, 7 and 8, the edges of the refractor are provided with shoulders 65 forming edges over which a U-shaped gasket 67 of rubber or the like can be placed to provide a weather seal when mounted on the housing.

Figure 9:
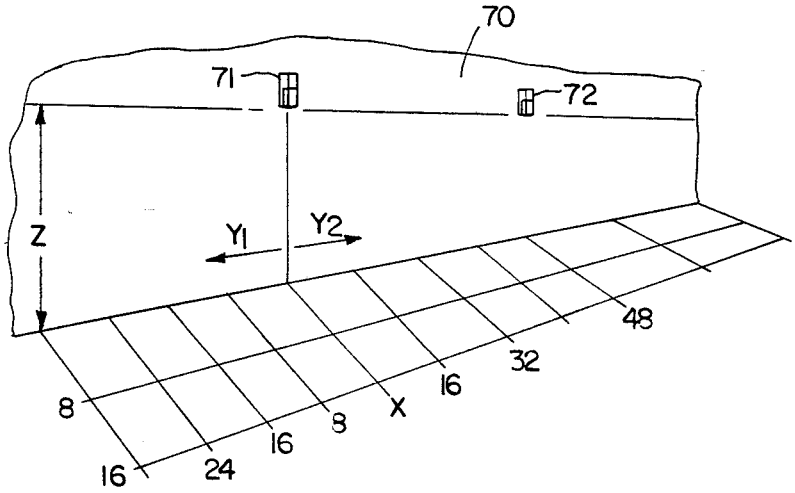
FIG. 9 is a schematic perspective view illustrating the illumination patterns produced by luminaires in accordance with the present invention.

FIG. 9 is an illustration which will be used to describe the light pattern produced by one or more luminaires in accordance with the present invention in a situation where an elongated wall is to be provided with one or more luminaires for the purpose of illuminating the region of the ground adjacent to the wall. The wall 70 in FIG. 9 is shown with luminaires 71 and 72 mounted thereon at a distance Z above the ground level. A simplified grid has been drawn on the ground surface which will be referred to for purposes of giving examples of the foot candle illumination produced by one luminaire having a 50 watt HPS lamp therein, and by two such luminaires mounted 48 feet apart. The foot candle measurements made under these circumstances are given in the following tables wherein the value X is a distance perpendicularly away from the wall and the distances Y1 and Y2 are the distances, respectively, to the left and right of luminaire 71. These distances will, however, be used to illustrate another aspect of the situation, the measurements in the direction of Y1 being foot candle values based on the presence of a single fixture. On the other hand, the values given in the direction Y2 will be those based on the presence of both of the luminaires, or on a sequence of such luminaires. The foot candle values based on a single fixture are given in Table I, as follows:

TABLE I

| X | Y1 | Z | FC |
|---|---|---|---|
| 0 | 0 | 8 | 1.6 |
| 0 | 8 | 8 | 1.6 |
| 0 | 16 | 8 | 1.6 |
| 0 | 24 | 8 | 0.4 |
| 8 | 0 | 8 | 2.3 |
| 8 | 8 | 8 | 1.5 |

TABLE I-continued

| X | Y1 | Z | FC |
|---|---|---|---|
| 8 | 16 | 8 | 1.3 |
| 8 | 24 | 8 | 0.3 |
| 16 | 0 | 8 | 0.9 |
| 16 | 8 | 8 | 0.9 |
| 16 | 16 | 8 | 0.3 |
| 16 | 24 | 8 | 0.3 |

It will be observed that all of these measurements are based on a mounting height of 8 feet. These values can be multiplied by factors of 0.64 and 0.44, respectively, for mounting heights of 10 and 12 feet.

The following table is the values in the direction Y2 for foot candles based on multiple fixtures.

TABLE II

| X | Y2 | Z | FC |
|---|---|---|---|
| 0 | 0 | 8 | 1.7 |
| 0 | 8 | 8 | 1.7 |
| 0 | 16 | 8 | 1.8 |
| 0 | 24 | 8 | 0.9 |
| 0 | 32 | 8 | 1.8 |
| 0 | 40 | 8 | 1.7 |
| 0 | 48 | 8 | 1.7 |
| 0 | 56 | 8 | 1.6 |
| 8 | 0 | 8 | 2.4 |
| 8 | 8 | 8 | 1.6 |
| 8 | 16 | 8 | 1.5 |
| 8 | 24 | 8 | 0.7 |
| 8 | 32 | 8 | 1.5 |
| 8 | 40 | 8 | 1.6 |
| 8 | 48 | 8 | 2.4 |
| 8 | 56 | 8 | 1.5 |
| 16 | 0 | 8 | 0.9 |
| 16 | 8 | 8 | 1.0 |
| 16 | 16 | 8 | 0.5 |
| 16 | 24 | 8 | 0.6 |
| 16 | 32 | 8 | 0.5 |
| 16 | 40 | 8 | 1.0 |
| 16 | 48 | 8 | 0.9 |
| 16 | 56 | 8 | 0.9 |

It will be observed that these values are also based on a mounting height of 8 feet and the same factors apply for mounting heights of 10 and 12 feet.

These advantageous light distribution values are obtained by a combination of interrelated features in the luminaire including the W-shape of the reflector together with its downward-rearward inclination; the distribution and shapes of the prisms and the curvature of the central portion 27 of the reflector. The inclination minimizes the amount of refraction which must be accomplished by the refractor in order to obtain a distribution of light below horizontal, thus maximizing efficiency.

The curvature of portion 27 causes light from the source 33 to be reflected back close to, but not directly through, the source. Ideally, a light ray reaching the refractor at a given point should receive it at the same angle whether it arrives from the lamp directly or from the reflector so that it will be refracted in the preferred direction. However, this would require that the reflected ray would need to travel back through the source. With HPS lamps this is not desirable because of diffusion and absorption which reduces efficiency and because of heating which tends to reduce lamp life. Thus, the curvature is selected so that reflected rays just miss the source.

The outer portions 28, 29 cause light reflected from the interior of the refractor back toward the wall 19 to be "rotated" forward, away from the wall to increase efficiency and improve candlepower in the desired directions. The combination of vertical and horizontal prisms refracts light away from the wall at the sides with the vertical interior prisms and, at the front, refracts light to the side and down. At the same time, the horizontal and bottom prisms spread light out and down and to the sides. The combination of these various light directing components results in a good distribution with high efficiency.

While one advantageous embodiment has been chosen to illustrate the invention, it will be understood by those skilled in the art that various changes and modifications can be made without departing from the scope of the invention as defined in the appended claims.

What is claimed is:

1. A luminaire for illuminating an area adjacent a generally vertical surface comprising a housing having a generally vertically rectangular back portion with a surface adapted to be mounted adjacent said vertical surface, said housing having an enclosed upper portion extending away from said back portion for supporting a generally downwardly extending lamp socket and for containing electrical components associated with energization of an axially elongated lamp having a predetermined circumference;

a lower portion supporting a reflector;

a lamp socket supported in said upper portion and extending in front of said lower portion with the central axis of said socket inclined at an acute angle with respect to a plane formed by said back portion toward a lower end of said back portion so as to support said lamp with its axis similarly inclined;

said reflector having an elongated central portion which is U-shaped in cross section as viewed along said central axis and extends at an acute angle paralleling said lamp and socket, said reflector encircling at least a fifth of the circumference of said lamp and forming axially extending distal edges;

said reflector having side portions extending rearwardly and outwardly from the distal edges of the central portion;

a transparent refractor having a front wall, side walls and a bottom wall shaped to enclose said lower portion including said lamp, socket and reflector; and means for releasably attaching said refractor to said back portion.

2. A luminaire according to claim 1 wherein said upper portion includes downwardly extending marginal walls substantially surrounding and enclosing an upper portion of said refractor to exclude dirt and moisture from the volume including said reflector and lamp.

3. A luminaire according to claim 2 wherein said lower portion includes forwardly extending marginal walls enclosing a rear side and bottom portions of said refractor, said forwardly extending walls joining said downwardly extending walls without interruption.

4. A luminaire according to claim 3 and further comprising an elastomeric gasket shaped to engage the distal edges of said refractor and to fit within and seal against said marginal walls.

5. A luminaire according to claim 1 wherein said front wall of said refractor lies in a substantially vertical plane, an inner surface of said front wall having a plurality of vertically extending ribs forming prisms thereon and an outer surface of said front wall having a plurality of horizontally extending ribs forming prisms thereon.

6. A luminaire according to claim 5 wherein each of said side walls lies in a generally vertical plane and includes a plurality of vertically extending ribs forming prisms on an inner surface thereof and a plurality of horizontally extending ribs forming prisms on an outer surface thereof.

7. A luminaire according to claim 6 wherein said bottom wall lies in a generally horizontal plane, an inner surface thereof including a plurality of ribs extending generally parallel with said vertical surface, an outer surface of said bottom wall having a plurality of ribs extending perpendicular to said ribs on said inner surface.

8. A luminaire according to claim 7 wherein said upper portion includes downwardly extending marginal walls substantially surrounding and enclosing an upper portion of said refractor to exclude dirt and moisture from the volume including said reflector and lamp.

9. A luminaire according to claim 8 wherein said lower portion includes forwardly extending marginal walls enclosing a rear side and bottom portions of said refractor, said forwardly extending walls joining said downwardly extending walls without interruption.

10. A luminaire according to claim 9 and further comprising an elastomeric gasket shaped to engage the distal edges of said refractor and to fit within and seal against said marginal walls.

* * * * *